United States Patent [19]

Lange et al.

[11] 4,263,479

[45] Apr. 21, 1981

[54] TERMINATED INDUCTIVE COIL ASSEMBLY

[75] Inventors: Glenn E. Lange, Omaha; Dennis M. Lynch, LaVista, both of Nebr.

[73] Assignee: Western Electric Company, Inc., New York, N.Y.

[21] Appl. No.: 974,197

[22] Filed: Dec. 28, 1978

[51] Int. Cl.[3] ..... H01F 17/08; H01F 27/06

[52] U.S. Cl. ..... 178/46; 336/68; 336/92

[58] Field of Search ..... 178/45–46; 336/65–68, 90, 92, 94, 96, 196, 208, 192, 107; 339/119 R, 121, 122 R, 125 R, 49 R

[56] References Cited

U.S. PATENT DOCUMENTS

| | | | |
|---|---|---|---|
| 2,147,245 | 2/1939 | Cox | 178/46 |
| 2,548,199 | 4/1951 | Crane et al. | 178/46 |
| 2,548,205 | 4/1951 | Drobish et al. | 178/46 |
| 2,548,206 | 4/1951 | Drom | 178/46 |
| 3,617,983 | 11/1971 | Patton | 339/98 |
| 3,628,202 | 12/1971 | Brown et al. | 29/278 X |
| 3,979,615 | 9/1976 | Neff | 336/192 X |
| 4,038,573 | 7/1977 | Hillyer et al. | 336/192 X |
| 4,105,985 | 8/1978 | Plunkett | 336/162 |
| 4,118,103 | 10/1978 | Leidy et al. | 339/98 |
| 4,132,460 | 1/1979 | Porta | 339/119 R |
| 4,172,964 | 10/1979 | Reinebach | 178/46 |
| 4,172,965 | 10/1979 | Eyestone et al. | 178/46 |

*Primary Examiner*—Marvin L. Nussbaum
*Attorney, Agent, or Firm*—E. W. Somers

[57] ABSTRACT

A toroidal coil (21) having two windings (23, 24) is packaged in a housing (22) which includes a first portion (39) having a cylindrical cavity (41) that extends between an open end and a closed end (43) of the first portion for receiving the coil. The housing also includes two arms (51-51) which extend from the first portion between planes which are substantially coincident with the open end and the closed end of the first portion. Each arm is connected to the first portion and has a free end with internally formed nests (72-72) for receiving contact elements (30-30). Each contact element has aligned, spaced slots (94, 101) at an inner end for terminating a lead of the winding and aligned, spaced slots (107, 111) at an outer end adjacent the free end of the arm in which it is mounted for terminating a conductor (31) of a cable to be loaded inductively. The nests are formed so that the inner and outer slots of the contact element are aligned along an axis transverse of an axis of the cylindrical cavity. The individually housed coil and the orientation of the contact elements facilitate termination of the coil leads and testing prior to the arrangement of a plurality of housed coils in a stack (34). Also, the arrangement of the coils in a stack permits machine connection of cable conductors to the contact elements and assembly of a plurality of the stacks into a load coil case for field use.

15 Claims, 9 Drawing Figures

TERMINATED INDUCTIVE COIL ASSEMBLY

TECHNICAL FIELD

This invention relates to a terminated inductive coil assembly, and, more particularly, to a modular arrangement of an inductive coil which is packaged individually in a housing and is terminated to facilitate testing of the coil and arranging of a plurality of the terminated coils in a stack to facilitate assembly into a loading coil case.

BACKGROUND OF THE INVENTION

Packaged arrangements of inductive coils are used extensively in telephone communications systems in which there is a need to add inductance to various types of circuits. In multi-pair conductor cable transmission systems, inductive coil assemblies are used to compensate for capacitance between conductor pairs. Assemblies of toroidally wound coils also find utility as inductive devices which are used to balance subscriber lines in telephone exchanges.

In order to load the conductors inductively, a cable is cut and coil assemblies are connected in series with the conductors to condition the electrical signals. Typically, groups of the coils, which are called loading coils, are placed a predetermined distance apart which may be on the order of about 1.6 kilometers.

The coils themselves are usually grouped together in an enclosure, which is referred to as a loading coil case. Generally, the loading coil case is a contoured plastic shell that includes a plurality of individual loading coil assemblies encapsulated in a potting compound such as polyurethane, for example, and that is either suspended from a cable or from a pole adjacent to the point at which the coil assemblies are spliced into the cable.

One problem associated with the manufacture of loading coil assemblies is that each of the individual toroidal coils in the load coil case includes two windings of relatively small size conductors such as, for example, 30 guage, the ends of which must be terminated and connected to conductors of the cable which is to be loaded. When coils wound of such size conductors are connected into electrical circuits, it is necessary to devise a means of connecting the coil conductors electrically to the relatively heavier conductors of a cable circuit without straining the coil conductors or breaking them. In many types of mounted transformers and coils, the ends of the windings are soldered to permanent terminals secured to insulating strips fastened to the coil mountings or to containers in which the coils are disposed.

Numerous prior art arrangements have been devised to package loading coils in an attempt to facilitate their assembly and the wiring of compact assemblages of individual coils. An example of the prior art may be found in U.S. Pat. No. 2,147,245 which discloses stacks of toroidal coils mounted on dowels and positioned within slit circular metallic tubes so that a number of tubes may be assembled and encapsulated within a metal casing. Further examples of packaged loading coils are disclosed in U.S. Pat. Nos. 2,548,199, 2,548,205, and 2,548,206, all of which issued on Apr. 10, 1951, in the names of E. J. Crane et al, W. M. Drobish et al, and E. L. Dron, respectively.

In order to provide a loading coil assembly which includes a compact array of individual toroidal coils that are relatively easy to connect within an inexpensive lightweight casing, a stack of coils are enclosed within a D-shaped case so that connection spaces for terminal strips are provided at the junctions of linear and arcuate sections of the case. This arrangement is disclosed and claimed in a copending commonly assigned application Ser. No. 864,304 filed Dec. 27, 1977 in the names of J. D. Eyestone and M. E. Szymanski, and now U.S. Pat. No. 4,172,965. The leads from the windings are wave-soldered to associated pins of the aforementioned terminal strips, after which plastic insulated conductors of a stub cable are connected to the pins and soldered so that the other ends of the stub cable may be connected to the cable, which effectively puts the loading coils into series with the outside plant cable to permit the coils to condition the transmission signals. These encased stacks of terminated coils, which are referred to as D-packs, may be compactly assembled into a molded outer casing such as that disclosed, for example, in copending, commonly assigned application Ser. No. 864,303 filed Dec. 27, 1977 in the name of J. Reinebach, and now U.S. Pat. No. 4,172,964.

While this arrangement replaces one in which a plurality of the load coils were arranged in layers, it does not provide a solution for the problem of the simple termination of relatively small gauge conductors of each individual coil, preferably by solderless techniques, prior to assembly into a stack. Moreover, it does not facilitate the individual testing of terminated inductive coils prior to their assembly into a D-pack, so that if a defective loading coil is found subsequent to its assembly into a D-pack, additional costs are incurred in its removal from the stack and replacement with an acceptable coil.

The prior art includes devices such as those shown, for example, in U.S. Pat. No. 3,979,615 for interconnecting substantially different gauge size conductors. While the arrangement in this last identified patent provides a contact element which simplifies the connection of a coil lead, for example, to a larger gauge size conductor, it is not adaptable to be assembled into a stack nor machine terminated. See also U.S. Pat. No. 4,038,573.

Seemingly, the known prior art does not include a solution for packaging and terminating individual coils in a manner which facilitates testing on an individual basis and which is adaptable to the mounting of a plurality of the coils in a stack for assembly into a case for use in outside telephone plant.

SUMMARY OF THE INVENTION

The foregoing problems of the prior art are overcome by a terminated inductive coil assembly which is constructed in accordance with the principles of this invention. A terminated inductive coil assembly for conditioning cable transmission signals in accordance with this invention includes a housing which includes a first portion having a cylindrical cavity which extends between an open end and a closed end of the first portion. The housing also includes a second portion comprising two arms which extend from the first portion between planes which are substantially coincident with the open end and the closed end of said first portion, each of said arms having one end which is integral with said first portion and an opposite free end which includes a nest therein. A toroidal coil having at least one winding with leads extending therefrom is mounted in the cylindrical cavity of the housing. At least one slotted beam type contact element having facilities for receiving and making electrical engagement with one of the leads of said coil and associated external conductor is mounted in the nest in each of the arms.

In a preferred embodiment, the arms are parallel and extend from diametral points of the first portion of the housing with two contact elements mounted in each arm. Each contact element has spaced, aligned conductor-receiving slots at an inner end thereof for terminating a lead of a coil winding and spaced, aligned slots at an outer end adjacent the free end of the arm in which it is mounted for terminating a conductor of a cable to be loaded inductively. The nests for receiving the contact elements are arranged so that the inner and outer slots of each of the contact elements are aligned along an axis which is transverse of an axis of the cavity of the first portion which extends between the planes.

BRIEF DESCRIPTION OF THE DRAWINGS

Other features of the present invention will be more readily understood from the following detailed description of specific embodiments thereof when read in conjuction with the accompanying drawings, in which.

DETAILED DESCRIPTION

Figure 1:
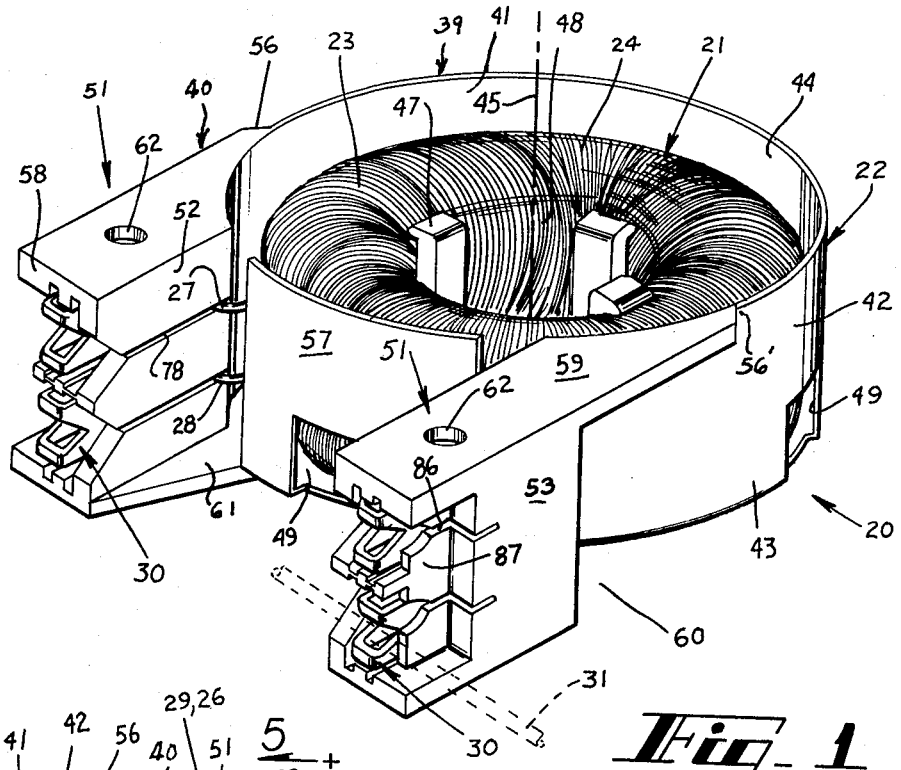
FIG. 1 is a perspective view of a terminated coil assembly with a toroidal coil mounted in a housing and showing contact elements for receiving leads of the coil as well as conductors from a cable to be loaded by the coil.
Figure 2:
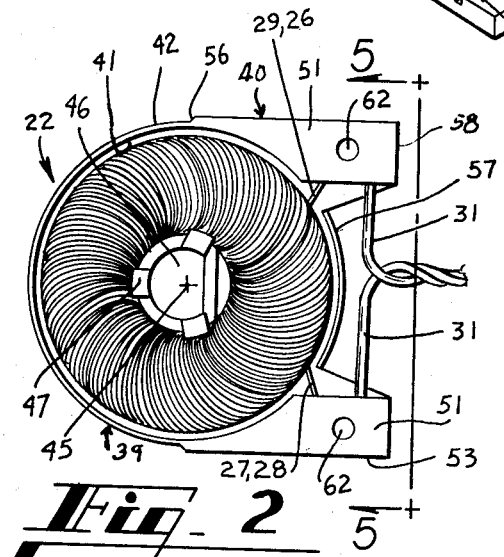
FIG. 2 is a plan view of the housing in FIG. 1 and showing conductors which have been attached to the contact elements in the housing.

Referring now to the drawings, FIG. 1 shows a terminated coil assembly, designated generally by the numeral 20, which includes a toroidal coil 21 and a molded housing 22. The coil 21 includes a first winding 23 which generally includes a red-colored magnet size conductor such as, for example, 30 gauge wire, and a green-colored winding 24 which is wound in the same direction as the red-colored winding about a toroidal core which is comprised of a powdered metal such as, for example, Permalloy metal. Although each of the two windings 23 and 24 of each coil 21 has the same direction of wind, they are connected onto the telephone circuits to balance out the conductor capacitance. The winding 23 includes an inner lead 26 and an outer lead 27 while the winding 24 includes an inner lead 28 and an outer lead 29. The inner and outer leads of the windings 23 and 24 in the coil assembly 20 are terminated in contact elements 30—30 to facilitate their connection to insulated conductors 31—31 (see FIG. 2) from an outside stub cable. Advantageously, the housing 22 and the contact elements 30—30 provide an individually packaged coil 21 which may be tested prior to an assembly of a plurality of them.

A plurality of terminated coil assemblies, such as, for example, twenty-five, are arranged in a stack 34 (see FIG. 3) on a plastic dowel 35 which is referred to as a terminated D-pack. Then a plurality of the terminated D-packs, such as, for example, thirty-six, are mounted in an enclosure such as that disclosed in the aforementioned Reinebach application and the assembly is called a loading coil case. The individual packaging of each coil 21 in a housing 22 facilitates a high density arrangement of a plurality of the coils in a load coil case which results in a less bulky profile than in priorly used arrangements.

The housing 22 is made from a plastic material such as, for example, polycarbonate or a reclaimed ABS (acrylonitrile-butadiene-styrene) material and includes a first portion 39 and a second portion 40 with the first portion 39 including a generally cylindrical cavity 41 (see FIGS. 1 and 2) having an axis 45, a side wall 42, a base 43 and an open top 44. The first portion 39 is formed with a central opening 46 in the base 43 and with a plurality of upstanding posts 47—47 which are biased outwardly toward the side wall 42 and which protrude through an opening 48 in the toroidal coil 21 to hold the coil within the housing 22.

As can be seen in FIG. 1, the first portion 39 of the housing 22 is constructed with access openings 49—49 adjacent the base 43 and spaced about its periphery. After the D-packs 34—34 are arranged in a load coil case 35, the case is encapsulated with a potting compound such as, for example, polyurethane. Without the access openings 49—49 in th housing 21 to insure that the possing compound fully encapsulates each coil 21, full encapsulation would depend on the ability of the potting compound to move between the coils 21—21 and the housing 22.

The second portion 40 of the housing 22 is formed with two linear, parallel arms 51—51 to provide the housing with a generally U-shaped configuration and to receive contact elements 30—30 which provide connections between the inner and outer leads of the windings of the toroidal coil 21 and the external insulated conductors 31—31. Each of the arms 51—51 includes an inner surface 52 and an outer surface 53 having extensions 54—54 which intersect the sidewall 42 at generally diametral points 56 and 56' of the portion 39 and terminating in free end surfaces 58—58. A rear wall 55 (see also FIG. 6) extends from the outer surface 53 to the inner surface 52 to form a wedge-shaped cavity 60 into which is moved a back-up tool (not shown) during the seating of the contact elements 30—30. The inner and the outer walls 52 and 53 of each of the arms 51 are connected through a flange 59, which is integral with the free circumferential edge of the sidewall 42, and a floor 61, which is an extension of the base 43.

Figure 3:
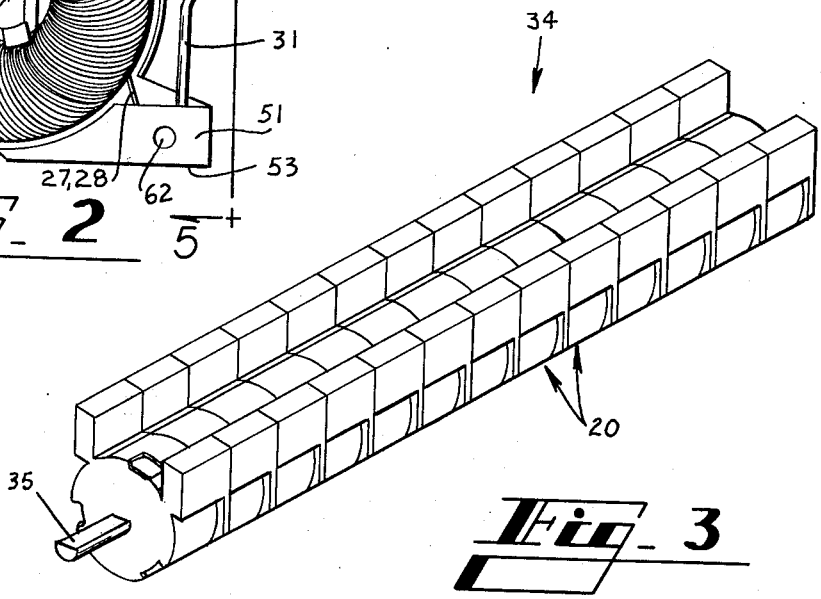
FIG. 3 is an assembly showing a plurality of the terminated coil assemblies arranged in a stack.
Figure 5:
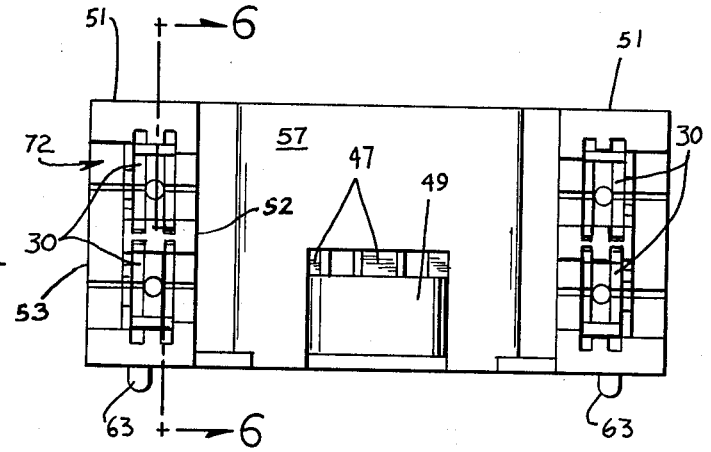
FIG. 5 is an end view of portions of the housing to show nests with contact elements therein and to show wells for cutting off excess lengths of conductor leads.

The housing 22—22 must be capable of being arranged in a stack to form a D-pack 34 of terminated coil assemblies as is shown in FIG. 3. This capability is provided by forming an opening 62 in each of the covers 59—59 of the arms 51—51 and an aligned pin 63—63 (see also FIG. 5) projecting from each of the floors 61—61 (see FIG. 1). The stack is formed by assembling a plurality of housings 22—22 so that the pins 63—63 are received in the opening 62—62 of the contiguous housing.

Figure 8:
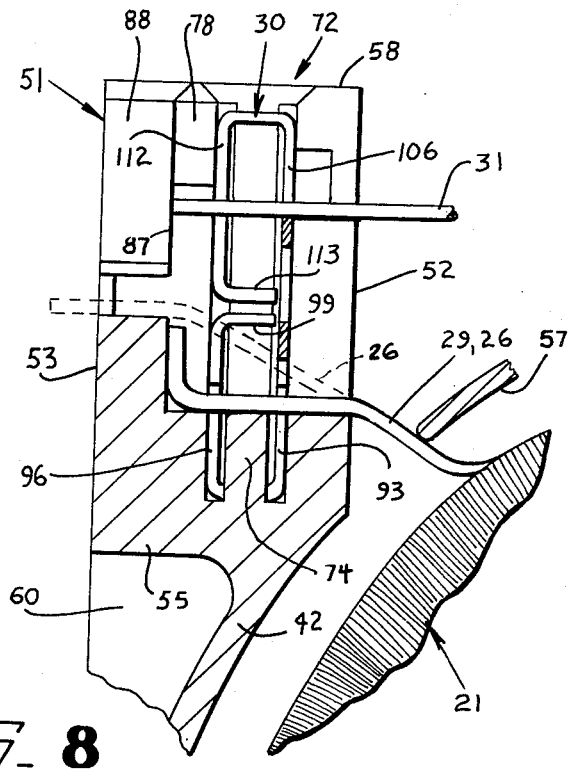
FIG. 8 is an enlarged plan view of a free end of one of two parallel arms of the housing which shows a nest, a contact element, a cutoff well and a coil lead wire and a conductor connected to the contact element.
Figure 9:
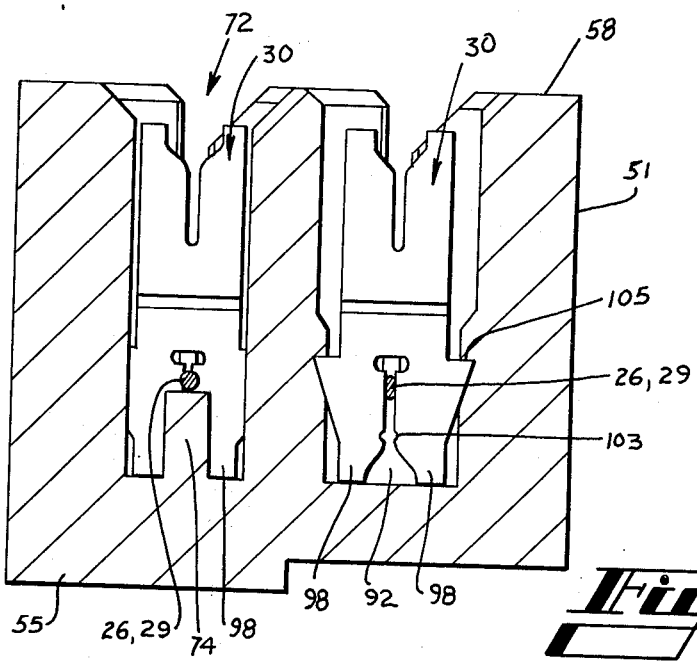
FIG. 9 is an elevation view in section taken through the portions of the housing in FIG. 5 along lines 9—9 thereof to show the contact elements as they are mounted in the nests.

The contact elements 52—52 must be mounted within the housing 12 to permit a connection between the inner and outer leads of the windings of the toroidal coils 21—21 and the individual conductors 31—31 of a stub cable (not shown) to be made with ease. In order to accomplish this, each of the linear arm portions 51—51 of the plastic housing 22 is constructed with compartmentalized nests 72—72 (see FIGS. 4 and 6) to receive two of the contact elements 30—30 in a stacked arrangement (see also FIGS. 5, 8 and 9) so that they open to the free end surfaces 58—58 of the arms 51—51 and so that they are secured against unintended movement.

Figure 6:
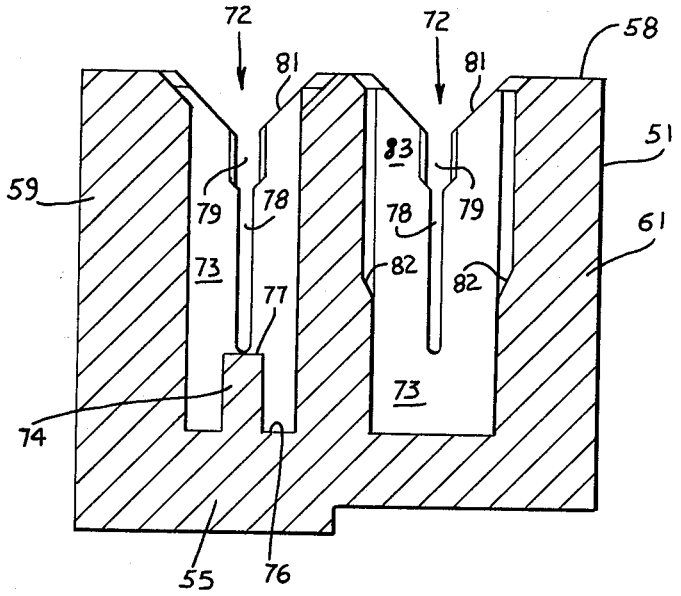
FIG. 6 is an elevational view in section of the nests of the housing for receiving the contact elements and taken along lines 6—6 of FIG. 5 and turned 90°.

As can best be seen in FIG. 6, each of the nests 72—72 includes a cavity 73 having the general configuration of one of the contact elements 30—30. Comparing FIGS. 5 and 6 it can be seen that the left hand portion of FIG. 6 is an elevational view partially in section and taken along the center plane through the nest while the right-hand portion is offset from that plane. Each nest 72 includes an anvil 74 projecting from an inner wall 76 and aligned along the center plane of the cavity 73. Moreover, a free end surface 77 of each anvil 74 is aligned with an inner end of a slot 78 which opens to the inner surface 52 of the arm 51. The width of the slot 78 is smaller than the outside diameter of the smallest guage conductor 31 to be received in he arm 51. As the slot 78 extends toward the surface 58 to which it opens, it is stepped out to a portion 79 which connects to a U-shaped entrance portion 81 that opens to the surface 58. Further viewing FIG. 6, and particularly the right-hand portion thereof, it can be seen that the portions of the cavity 73 adjacent the inner and outer surfaces 52 and 53, respectively are stepped out along beveled surfaces 82—82 to form an enlarged width cavity 83.

Figure 4:
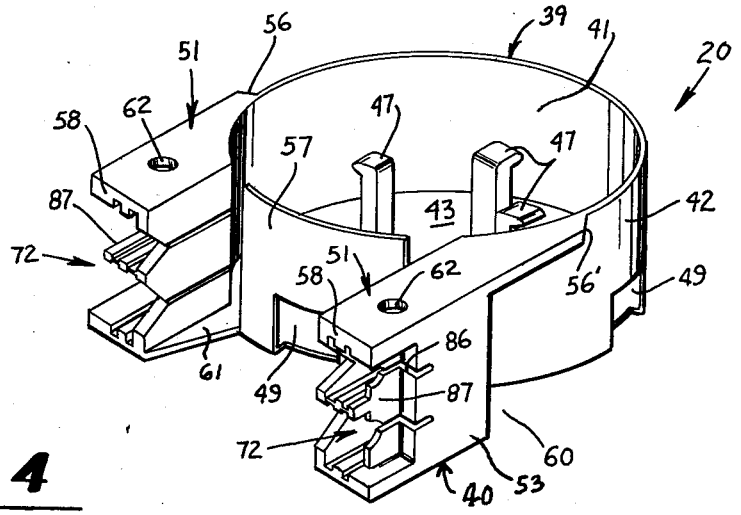
FIG. 4 is a perspective view of the housing of FIG. 1.

Each of the linear arm portions 51—51 of the housing 22 includes a slot 86 (see FIG. 1 and 8) along a side 87 of the nest 72 which is adjacent the outer surface 53 so that the slots 86 and 78 will be aligned with each other and with conductor-receiving slots formed in the contact elements 30—30 when the latter are mounted within the housing 22. Viewing now the end sections of the linear arm portions 51—51 of the housing 22 as seen in FIGS. 1 and 4, it can be seen that the walls 87—87 which define the nests 72—72 which receive the contact elements 30—30 are spaced from the outside surface 53 of the housing to form cut-off wells 88—88. It is within the scope of this invention to continue the outer surfaces 53—53 to the free ends 58—58 of the arms 51—51 in which event those surfaces would be provided with slots which are aligned with the slots 78—78. The wells 88—88 which are formed between the walls 87—87 and the outer surfaces 53—53 provide sufficient distance between a conductor end exposed on the outer side of the contact element 30 and a conductor end of an adjacent D-pack to avoid breakdown therebetween.

Figure 7:
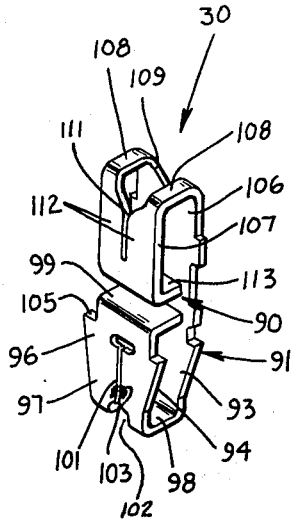
FIG. 7 is an enlarged view of one of the contact elements which is adapted to be mounted in a nest in the housing shown in FIG. 1.

The contact element 30 which is used to terminate the leads of the coil 21 is one such as is available commercially from AMP, Inc. of Harrisburg, Pennsylvania as described in a brochure entitled AMP's Magnet Wire Interconnection System as well as in U.S. Pat. Nos. 3,617,983 and 4,118,103. The contact element 30 (see FIG. 7) includes a main body portion 90 having two oppositely extending bifurcated beam assemblies 91 and 92 which are turned from the main body portion and back into engagement therewith.

The beam assembly 91 includes furcations 93—93 which form a conductor-receiving slot 94 and a parallel, reversely folded portion 96 having furcations 97—97 which are connected to the furcations 93—93 through portions 98—98. The furcations 93—93 terminate in an end 99 which is downturned into engagement with the main body portion 90. A slot 101 which is formed between the furcations 97—97 is aligned with the slot 94 in the main body portion 90. Further, the connecting portions 98—98 have an opening 102 which is centrally disposed therebetween to provide an entrance into the aligned slots 94 and 101.

The opening 102 is adapted to cooperate with the structure of the nest 72 and specifically one of the anvils 74—74 to facilitate the insertion of one of the coil leads 26–29. The contact element 30 is formed so that it is capable of making electrical contact with one of the enameled wire coil leads 26–29, each of which comprises a 30 guage copper conductor covered with polyurethane and nylon such as, for example, one marketed by the Phelps-Dodge Corporation under a tradename NYLEZE wire. In order to accomplish this, the contact element 30 which is available from the AMP Company includes two oppositely disposed burr sections 103—103 along the stripping portion of the walls which define the slots 91 and 94 and which accomplish the insulation displacement.

In order to be secured wihin the nests 72—72 against unintended movement, the contact elements 30—30 include barbs 105—105 that are formed on the lateral edges of the furcations 93—93 and 96—96. These barbs 105—105 are designed to bite into and become embedded in the plastic of which the housing 22 is molded to secure the contact element 30 within its associated nest.

The conductors 31—31 which are connected to the coil leads 26–29 through the contact elements 30—30 are individually insulated conductors in the range of 24 to 26 guage. The other one of the bifurcated beam assemblies 92 has a structure similar in fashion to that of bifurcated beam assembly 91 with furcations 106—106 defining a slot 107 therebetween and connected through portions 108—108 which define a flared entrance portion 109 to a slot 111 defined between furcations 112—112. The furcations 112—112 which have a conductor-receiving slot 112 formed therebetween has a portion 113 depending therefrom and engaging the main body portion 90.

The housing 22 of this invention for packaging the induction coil 21 facilitates connection of the coil to the contact elements 30—30 and the assembly of a plurality of the packaged coils into a D-pack 35. An operator grasps the inner and outer leads 26–29 of the two windings 23 and 24 and moves each of the leads through an associated one of the two aligned slots 78 and 87 in each arm 51 of the plastic housing 22. Then with the lead taut through the slots (see dashed outline of lead 26 in FIG. 8), the operator causes the contact element 30 to be inserted into each nest 72 so that the bifurcated beam assembly 91 having the smaller conductor-receiving slot 101 is moved into its associated nest 72 to cause the barbs 105—105 to become embedded in the plastic (see FIG. 9) to anchor the contact element within the housing. One of the coil leads 26–29 is caused to be moved in the associated slot formed between the furcations 93—93 and 96—96 and past the opposing burrs 103—103 to establish electrical contact between the contact element 30 and the lead. Also, as the contact element 30 is firmly seated within its associated nest 72, the lead is moved into engagement with the anvil 74 (see FIGS. 8 and 9) which supports the lead between the furcations 93—93 and the furcations 96—96 during the remaining travel of the contact element. The excess lengths of the coil leads 26–29 are severed therefrom and the free end of each coil lead is stuffed into an internal corner formed in the molded housing 22 (see FIG. 8). The furcations 106—106 and 112—112 which form the larger conductor-receiving slots 107 and 111, respectively, are disposed towards the ends of the nests which open to the surfaces 58—58 where stub cable conductors 31—31 may be moved into the slots after assembly into a D-pack 34 to connect the conductors to the coil windings 23 and 24.

After each of the coils 21—21 has been terminated and after a plurality of the terminated coil assemblies 20—20 have been arranged in a stack 34, stub cable conductors 31—31 are inserted into the slots 107—107 and 111—111 of the outwardly facing bifurcated beams of the contact elements 30—30. Since those furcations are exposed and all oriented in the same direction, the D-pack 34 lends itself to being machine terminated with the conductors 31—31. Any one of several well known apparatus such as a turntable or linear rack may be used to index an insertion head or the D-pack so that all of the conductors 31—31 of each assembly 20 or all those of each of a plurality of assemblies 20—20 may be inserted simultaneously. As the conductors 31—31 are moved into the slots 107—107 and 111—111 of the contact elements 30—30, their ends are severed between the surfaces 53—53 of the arms 51—51 and the walls 87—87 of the nests 72—72. This causes the free end of each of the conductors 31—31 to be spaced from the outer surface 54. Otherwise, since D-packs are adjacent one another in the loading coil case, cut-off ends of the connector conductors 31—31 adjacent the outside wall 53 could short and cause a failure during a breakdown test. Their cut-off short of the outside surfaces 53—53 insures that the cut ends are spaced a sufficient distance to prevent breakdown.

It is to be understood that the above-described arrangements are simply illustrative of the invention. Other arrangements may be devised by those skilled in the art which will embody the principles of the invention and fall within the spirit and scope thereof.

What is claimed is:

1. A terminated inductive coil assembly, which comprises:

a housing which includes;

a first portion having a cavity for receiving a toroidal core, said portion having at least one open end and another end which is oppposite to said open end, said open end adapted to receive a toroidal core; and a second portion which includes at least one arm having one end that is connected to and that extends from said first portion and another free end having a contact element-receiving nest formed therein, said at least one arm extending from said first portion between two planes which are parallel to planes through said open end and said other end of said first portion:

a coil received in said cylindrical cavity and having at least one winding with leads extending from the winding; and a contact element which is mounted in each of said nests for receiving and making electrical engagement with one of said leads of said coil and with an associated external conductor.

2. The coil assembly of claim 1, wherein said housing is generally U-shaped and includes two parallel arms extending from and substantially tangent to said first portion, each of said arms having a pair of nests with a contact element mounted in each of said nests.

3. The coil assembly of claim 2, wherein each of said contact elements has a pair of spaced, aligned conductor-receiving slots at each end thereof with one pair being disposed at an inner end of an associated nest and the other pair being disposed at an outer end of the associated nest adjacent the free end of the arm, and said nests for receiving said contact elements being arranged so that the inner and outer slots of the contact element are aligned along an axis transverse of an axis of the cylindrical cavity which extends between said planes.

4. The coil assembly of claim 3, wherein said axes of said contact elements in each of said arms are disposed in a single plane.

5. The coil assembly of claim 1, wherein the first portion of said housing includes a peripheral wall upstanding from the other end and a plurality of openings spaced about the peripheral wall adjacent the other end to provide access for waterproofing encapsulant to be moved between the coil and the peripheral wall.

6. The coil assembly of claim 1, wherein the other end of the first portion of said housing is closed and is formed with an opening at the center thereof, and a plurality of posts upstanding from said closed end, biased outwardly, and disposed about said opening, said posts being received within the opening in said toroidal coil to hold said coil within said cavity.

7. The coil assembly of claim 5, wherein each arm is formed to provide a cut-off well adjacent each nest, said well being formed adjacent an outside surface of said arm which intersects said peripheral wall, each of said nests and said wells having aligned slots extending therethrough for receiving one of said coil leads so that the insertion of a contact element within its associated nest causes the lead prepositioned in the aligned slots to be received in an inner pair of said spaced, aligned conductor-receiving slots of the contact element with a leading end portion severed and a newly formed end portion being stuffed into an internal corner of said nest and so that the insertion of external condustors into the outer pair of said conductor-receiving slots of each contact element causes end portions of the external conductors to be severed within said wells.

8. The coil assembly of claim 2, wherein the first portion of said housing includes a peripheral wall upstanding from the other end to define the cylindrical cavity and each of said arms is connected to the housing through a top flange which is parallel to said planes and by interior and exterior walls, said exterior walls lying in a plane which is substantially tangent to the peripheral wall and having a rear wall of the arm extending from it to the peripheral wall to form a wedge-shaped cavity for receiving a back-up tool during the insertion of the contact elements into said nests in said arms.

9. The coil assembly of claim 8, wherein said peripheral wall between said arms is discontinued to provide an opening between it and each arm to permit a coil lead to be moved into the slots in the arms prior to insertion of the contact elements.

10. A loading coil assembly, which comprises:

a plurality of inductive coil assemblies each of which comprises:

a U-shaped housing which includes a cylindrical portion having a closed end, which includes a centrally disposed opening, and an open end, and two parallel arms extending from and tangent to the cylindrical portion, each of said arms having one end integral with the cylindrical portion and another end being free and having nests formed therein;

a toroidal coil having two windings with two leads from each winding extending therefrom, said coil being received in said cylindrical portion; and a pair of contact elements mounted in the nests in each of said arms with each of the elements receiving and making electrical engagement with one of said leads of said coils and an associated external conductor; and a rod which extends through the centrally disposed opening of each of said housings and aligned openings of the toroidal coils received therein.

11. The loading coil of claim 10, wherein each said housing includes a plurality of lugs projecting from one side of said housing and a plurality of openings on an opposite side thereof, the lugs of each housing being received in the aligned openings of a contiguous housing when the assemblies are mounted on the rod.

12. A housing for holding a toroidal coil, which comprises:

a first portion having a cylindrical cavity which extends between an open end and a closed end of the first portion; and a second portion comprising two arms which extend from the first portion and between planes which are substantially coincident with the open end and the closed end of said first portion, each of said arms having one end which is integral with the first portion and an opposite free end which includes at least one nest formed therein.

13. The housing of claim 12, wherein the first portion of said housing includes a peripheral wall upstanding from the closed end and a plurality of openings spaced about the peripheral wall adjacent the base to provide access for waterproofing encapsulant to be moved between the coil and the peripheral wall.

14. The housing of claim 12 wherein the closed end of the first portion of said housing is formed with an opening at the center thereof, and a plurality of posts upstanding from said closed end, biased outwardly, and disposed about said opening, said posts being received within the opening in said toroidal coil to hold said coil within said cavity.

15. The housing of claim 12, wherein the first portion of said housing includes a peripheral wall upstanding from the closed end and wherein each arm is formed to provide a cut-off well adjacent each nest, said well being formed adjacent an outside surface of said arm which intersects said peripheral wall, each of said nests and said wells having aligned said peripheral wall, each of said nests and said wells having aligned slots extending therethrough for receiving a lead of said coil so that the insertion of a contact element within its associated nest causes the lead prepositioned in the aligned slots to be received in one of said conductor-receiving slots of the contact element with a leading end portion severed and a newly formed end portion being stuffed into an internal corner of said nest and so that the insertion of external conductors into the other conductor-receiving slots of each contact element causes end portions of the external conductors to be severed within said wells.

* * * * *